US008907744B2

(12) United States Patent
Moon et al.

(10) Patent No.: US 8,907,744 B2
(45) Date of Patent: Dec. 9, 2014

(54) MULTI-LINE PHASE SHIFTER HAVING A FIXED PLATE AND A MOBILE PLATE IN SLIDEABLE ENGAGEMENT TO PROVIDE VERTICAL BEAM-TILT

(75) Inventors: Young-Chan Moon, Gyeonggi-do (KR); Oh-Seog Choi, Gyeonggi-do (KR); In-Ho Kim, Gyeonggi-do (KR); Kwang-Seok Choi, Gyeongsangbuk-do (KR)

(73) Assignee: KMW Inc., Hwaseong (KR)

( * ) Notice: Subject to any disclaimer, the term of this patent is extended or adjusted under 35 U.S.C. 154(b) by 349 days.

(21) Appl. No.: 13/319,389

(22) PCT Filed: May 11, 2010

(86) PCT No.: PCT/KR2010/002993

§ 371 (c)(1),
(2), (4) Date: Nov. 8, 2011

(87) PCT Pub. No.: WO2010/131895

PCT Pub. Date: Nov. 18, 2010

(65) Prior Publication Data

US 2012/0056692 A1 Mar. 8, 2012

(30) Foreign Application Priority Data

May 11, 2009 (KR) ..... 10-2009-0040978

(51) Int. Cl.

| | |
|---|---|
| ***H01P 1/18*** | (2006.01) |
| ***H01Q 3/30*** | (2006.01) |
| ***H01Q 3/26*** | (2006.01) |

(52) U.S. Cl.

CPC . *H01Q 3/26* (2013.01); *H01Q 3/30* (2013.01); *H01P 1/184* (2013.01)

USPC ..... 333/161; 333/128

(58) Field of Classification Search

CPC ..... H01P 1/184; H01P 1/18

USPC ..... 333/161, 156, 128, 136

See application file for complete search history.

(56) References Cited

U.S. PATENT DOCUMENTS

| | | | |
|---|---|---|---|
| 5,917,455 | A | 6/1999 | Huynh et al. |
| 6,831,602 | B2 | 12/2004 | McKinzie, III et al. |

(Continued)

FOREIGN PATENT DOCUMENTS

| | | | |
|---|---|---|---|
| CN | 1666378 | A | 9/2005 |
| CN | 201181729 | Y | 1/2009 |

(Continued)

*Primary Examiner* — Benny Lee

(74) *Attorney, Agent, or Firm* — Edwards Wildman Palmer LLP; Kongsik Kim

(57) ABSTRACT

A Multi-Line Phase Shifter (MLPS) for a vertical beam tilt-controlled antenna is provided, in which a housing is shaped into an elongated rectangular box, a fixed plate is attached on an inner bottom surface of the housing and has transmission lines printed thereon, the transmission lines forming part of a plurality of phase shifting patterns and a plurality of signal division patterns, for dividing an input signal and shifting phases of divided signals, and a mobile plate is installed within the housing, movably along a length direction at a position where the mobile plate contacts a surface of the fixed plate, and has transmission lines printed thereon, the transmission lines forming a remaining part of the plurality of phase shifting patterns for phase shifting by forming variable lines through coupling with the part of the plurality of phase shifting patterns.

8 Claims, 6 Drawing Sheets

(56) References Cited

U.S. PATENT DOCUMENTS

| | | | | |
|---|---|---|---|---|
| 2003/0016097 | A1 | 1/2003 | McKinzie, III et al. | |
| 2005/0179507 | A1 | 8/2005 | Yoon | |
| 2005/0184827 | A1* | 8/2005 | Pallone et al. | 333/161 |
| 2005/0248494 | A1 | 11/2005 | Davies | |
| 2006/0109066 | A1 | 5/2006 | Borysenko | |
| 2008/0297273 | A1* | 12/2008 | Murano | 333/161 |
| 2011/0140805 | A1* | 6/2011 | Liu et al. | 333/161 |

FOREIGN PATENT DOCUMENTS

| | | | |
|---|---|---|---|
| JP | 03-214787 | A | 9/1991 |
| JP | 2001-237603 | A | 8/2001 |
| JP | 2002-164706 | A | 6/2002 |
| WO | 03/019723 | A1 | 3/2003 |
| WO | 2004/008568 | A1 | 1/2004 |
| WO | 2007/073638 | A1 | 7/2007 |

* cited by examiner

MULTI-LINE PHASE SHIFTER HAVING A FIXED PLATE AND A MOBILE PLATE IN SLIDEABLE ENGAGEMENT TO PROVIDE VERTICAL BEAM-TILT

CROSS-REFERENCE TO RELATED APPLICATION(S)

The present application claims priority under 35 U.S.C. §365 to International Patent Application No. PCT/KR2010/002993 filed May 11, 2010, entitled "MULTI-LINE PHASE SHIFTER FOR VERTICAL BEAM TILT-CONTROLLED ANTENNA". International Patent Application No. PCT/KR2010/002993 claims priority under 35 U.S.C. §365 and/or 35 U.S.C. §119(a) to KPA No. 10-2009-0040978 filed May 11, 2009 and which is incorporated herein by reference into the present disclosure as if fully set forth herein.

BACKGROUND (a) Technical Field

The embodiments of the present invention relate generally to an antenna in a mobile communication system and more particularly, to a Multi-Line Phase Shifter (MLPS) being a core part for controlling the vertical beam tilt of an antenna.

(b) Description of the Related Art

Although a fixed antenna was initially used for a Base Station (BS) in a mobile communication system, a vertical beam tilt-controlled antenna capable of vertical and/or horizontal beam tilting has recently been popular due to its benefits. For the vertical beam tilt-controlled antenna, mechanical beam tilting and electrical beam tilting are available.

Mechanical beam tilting relies on a manual or force-driven bracket structure at a portion engaged with a support pole in an antenna. The installation inclination of the antenna is changed according to an operation of the bracket structure, thereby enabling the vertical beam tilting of the antenna. Meanwhile, electrical beam tilting is based on an MLPS. Vertical beam tilting is electrically achieved for an antenna by changing the phase difference between signals provided to vertically arranged antenna radiation elements. An example of the vertical beam tilting technology is disclosed in U.S. Pat. No. 6,864,837 entitled "Vertical Electrical Downtilt Antenna", filed by EMS Technologies, Inc. (invented by Donald L. Runyon, et al. and issued on Mar. 8, 2005).

An MLPS is a requisite for electrical vertical beam tilting. The MLPS is used in a variety of fields of a Radio Frequency (RF) analog signal processing end, for phase modulation as well as beam control of a phase array antenna. The MLPS operates based on the principle that a phase difference is incurred between an input signal and an output signal by appropriately delaying the input signal. The phase difference can be obtained by simply differentiating the physical length of a transmission line or differentiating a signal propagation speed along a transmission line in various manners. The MLPS is usually configured so as to change a phase shift by changing the length of a transmission line, for example.

Especially, mobile communication systems have recently required a technique for harmoniously changing the phase of each radiation element in a phase array antenna in order to adjust the coverage of a BS through control of the vertical beam angle of the phase array antenna in the BS. To meet this demand, MLPSs of various structures have been developed and widely used. Particularly, an MLPS may have a structure for dividing an input signal into a plurality of output signals and appropriately controlling the phase difference of each output signal. For example, a technology related to an MLPS for vertical beam tilting is disclosed in U.S. Pat. No. 6,831,692 entitled "Low Cost Trombone Line Beamformer" filed by Etenna Corporation (invented by William E. McKinzie, III, et al. and issued on Dec. 14, 2004).

However, the developmental efforts of the MLPS were expended mainly toward improvement of its structure or improvement of the performance of changing the phase of a processed signal, but with no regard to the structure of an antenna in which the MLPS is installed, such as a phase array antenna. Accordingly, there exists a need for studying and developing an MLPS with an improved performance and structure.

SUMMARY OF THE INVENTION

An aspect of exemplary embodiments of the present invention is to address at least the problems and/or disadvantages and to provide at least the advantages described below. Accordingly, an aspect of exemplary embodiments of the present invention is to provide an MLPS having an optimum structure and a stable mechanical structure, for use in a vertical beam tilt-controlled antenna.

Another aspect of exemplary embodiments of the present invention is to provide an MLPS for reducing signal loss, for use in a vertical beam tilt-controlled antenna.

A further aspect of exemplary embodiments of the present invention is to provide an MLPS for preventing twisting of a power supply cable, for use in a vertical beam tilt-controlled antenna.

In accordance with an aspect of exemplary embodiments of the present invention, there is provided a Multi-Line Phase Shifter (MLPS) for a vertical beam tilt-controlled antenna, in which a housing is shaped into an elongated rectangular box, a fixed plate is attached on an inner bottom surface of the housing and has transmission lines printed thereon, the transmission lines forming part of a plurality of phase shifting patterns and a plurality of signal division patterns, for dividing an input signal and shifting phases of divided signals, and a mobile plate is installed within the housing, movably along a length direction at a position where the mobile plate contacts a surface of the fixed plate, and has transmission lines printed thereon, the transmission lines forming a remaining part of the plurality of phase shifting patterns for phase shifting by forming variable lines through coupling with the part of the plurality of phase shifting patterns.

As is apparent from the above description, the MLPS for a vertical beam tilt-controlled antenna according to the present invention can have an optimal structure and a stable mechanical structure. Also, the MLPS can reduce the loss of a processed signal because a power supply cable is not twisted.

BRIEF DESCRIPTION OF THE DRAWINGS

The above and other objects, features and advantages of certain exemplary embodiments of the present invention will be more apparent from the following detailed description taken in conjunction with the accompanying drawings, in which.

Throughout the drawings, the same drawing reference numerals will be understood to refer to the same elements, features and structures.

DETAILED DESCRIPTION OF THE EMBODIMENTS

The matters defined in the description such as a detailed construction and elements are provided to assist in a comprehensive understanding of exemplary embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
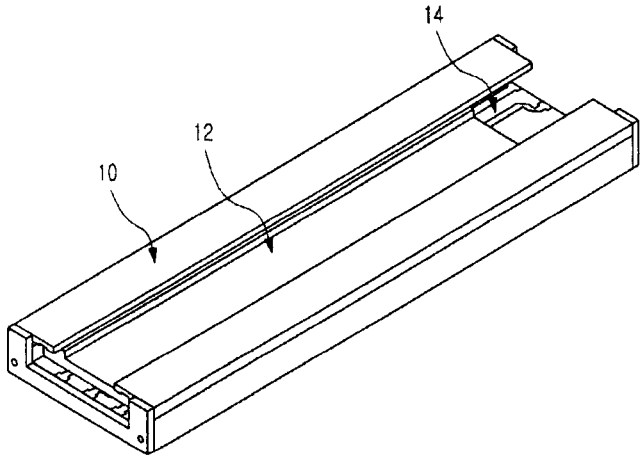
FIG. 1 is an exterior perspective view of an important part of an MLPS for a vertical beam tilt-controlled antenna according to an exemplary embodiment of the present invention.
Figure 2:
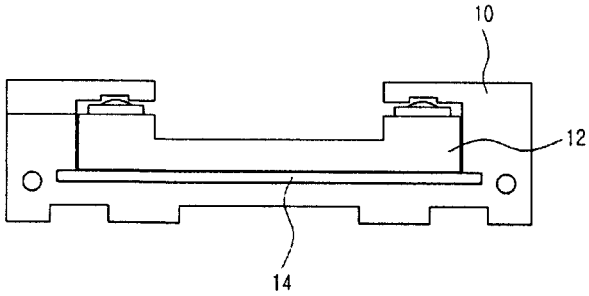
FIG. 2 is a frontal view of FIG. 1.

FIG. 1 is an exterior perspective view of an important part of an MLPS for a vertical beam tilt-controlled antenna according to an exemplary embodiment of the present invention, and FIG. 2 is a frontal view of FIG. 1.

Referring to FIGS. 1 and 2, the MLPS according to the present invention is provided with a housing 10 shaped into an elongated rectangular box (i.e. a vertically elongated rectangular hexahedron). Normally, the radiation elements in the phase array antenna that is vertically extended are vertically arranged. This shape of the housing 10 of MLPS facilitates installation in a vertical beam tilt-controlled antenna that is also vertically extended, for example, on a bottom or side surface of a reflection plate.

The MLPS is fixedly attached onto a bottom surface of the housing 10. Patterns for connection one input port (not shown) to a plurality of output ports (not shown) through which signals divided from an input signal are output are printed at upper and lower ends of the housing 10 with respect to a length direction of the housing 10. The MLPS further includes a fixed plate 14 on which transmission lines forming a part of a plurality of phase shifting patterns and a plurality of signal division patterns between the input part and the plurality of output ports are printed in order to divide the input signal and change the phases of the divided signals.

The MLPS also includes a mobile plate 12 which is installed to slide lengthwise at a position where it contacts a surface of the fixed plate 14. Transmission lines that form the remaining part of the plurality of phase shifting patterns for shifting phase by forming variable lines through coupling to the part of the plurality of phase shifting patterns of the fixed plate 14 are formed on a surface of the mobile plate 12 contacting the surface of the fixed plate 14.

The part of the plurality of phase shifting patterns printed on the fixed plate 14 are coupled to the remaining part of the plurality of phase shifting patterns printed on the mobile plate 12, thus realizing the MLPS. As the mobile plate 12 moves, the plurality of phase shifting patterns each having a variable line structure change phases proportionally or inversely proportionally. The mobile plate 12 is formed by attaching a thin substrate onto a housing of the mobile plate 12. The plurality of phase shifting patterns of the variable line structures are printed in a row upon a reference axis along the moving direction of the mobile plate 12. Therefore, the whole plate structure can be elongated along the length direction. In addition, since the two plates 12 and 14 are stacked within the housing 10, the MLPS is made slim.

Typically, an MLPS is connected to an additional single input divider in order to implement, for example, a 5-way divider. This design may reduce the size of the MLPS, but increases signal loss due to an increased length of a power supply line (cable). On the other hand, the MLPS of the present invention is designed by integrating a 5-way divider and a phase shifting circuit into one plate, and laid out along the length of an antenna. Therefore, length loss is mitigated and the size of the MLPS is decreased, without twisting the cable.

In the thus-constituted MLPS, the plurality of transmission lines printed on the fixed plate 14 and the mobile plate 12 may be implemented into microstrip lines or strip lines. In addition, the fixed plate 14 and the mobile plate 12 may be configured with air substrates or dielectric substrates. An insulation layer is formed of an appropriate material on at least one of the contacting surfaces of the fixed plate 14 and the mobile plate 12 so that the mobile plate 12 may slide smoothly on the fixed plate 14 and the microstrip lines facing each other may be protected against friction-caused breakage.

An opening is formed on one surface of the housing 10, for example, on the top surface of the housing 10 as illustrated in FIGS. 1 and 2, to thereby expose part of the mobile plate 12. Thus a manual or force-driven driver may be connected to the mobile plate 12 through the opening so that the mobile plate 12 moves along the length of the housing 10. The driver may be configured so as to control two MLPSs individually as well as simultaneously.

Figure 3:
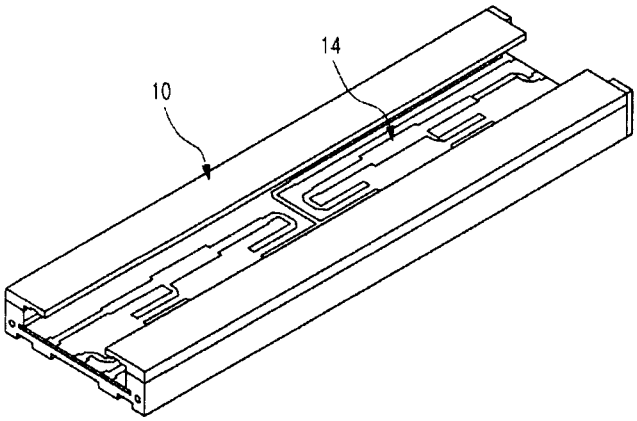
FIG. 3 is a perspective view of a housing and a fixed plate illustrated in FIG. 1.
Figure 4:
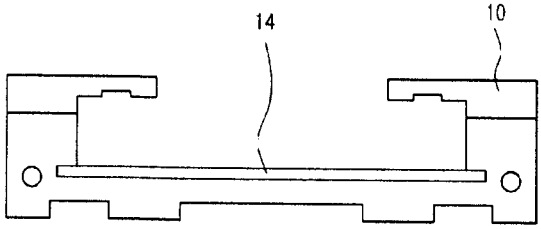
FIG. 4 is a frontal view of FIG. 3.

FIG. 3 is a perspective view of the housing and the fixed plate illustrated in FIG. 1 and FIG. 4 is a frontal view of FIG. 3.

Referring to FIGS. 3 and 4, the fixed plate 14 is mounted on an inner bottom surface of the housing 10. The fixed plate 14 is soldered or bonded to the housing 10 in such a manner that contacting surfaces of the fixed plate 14 and the housing 10 are as close as possible. The resulting reduction of flexure or distortion leads to smooth sliding of the mobile plate 12 on the top surface of the fixed plate 14 on which the transmission lines are printed. To improve Passive Inter-Modulation Distortion (PIMD), the fixed plate 14 may be brought into electrically perfect contact with the housing 10 by soldering.

Figure 5:
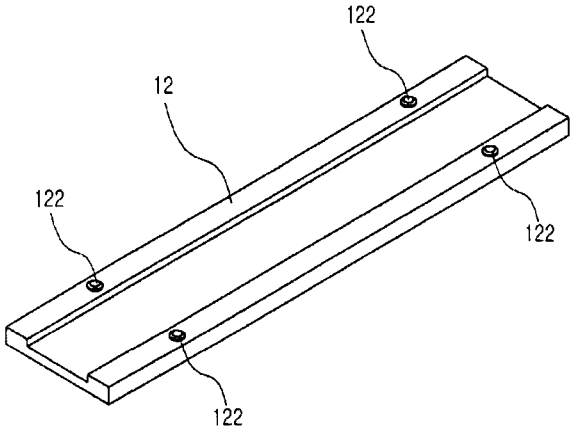
FIG. 5 is a perspective view of a mobile plate illustrated in FIG. 1.
Figure 6:
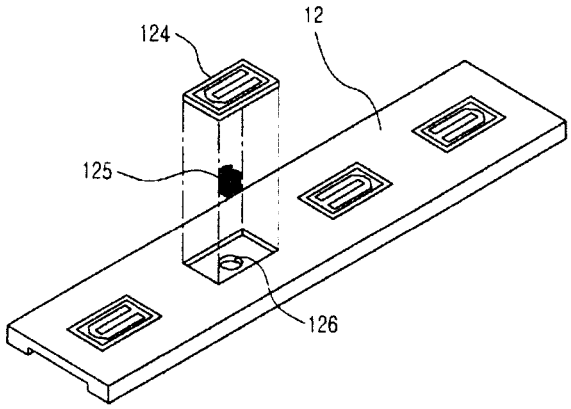
FIG. 6 is a bottom perspective view of the mobile plate illustrated in FIG. 5.

FIG. 5 is a perspective view of the mobile plate illustrated in FIG. 1 and FIG. 6 is a bottom perspective view of FIG. 5.

Referring to FIGS. 5 and 6, a plurality of ball plungers 122 (see FIG. 5) are provided on a top surface of the mobile plate 12, that is, a surface of the mobile plate 12 facing an inner top surface of the housing 10 (see FIGS. 1 and 2). The ball plungers 122 function to press the mobile plate 12, when the mobile plate 12 is mounted in the housing 10. Therefore, the mobile plate 12 may closely contact the fixed plate 14 (see FIGS. 1-4) and slide more smoothly with respect to the inner top surface of the housing 10.

Referring to FIG. 6, the plurality of phase shifting patterns are formed on a bottom surface of the mobile plate 12, for coupling with part of the plurality of phase shifting patterns of the fixed plate 14. The plurality of phase shifting patterns are individually printed on a plurality of sub-plates 124 that can be individually inserted into and detached from the bottom surface of the mobile plate 12, rather than being printed on the bottom surface of the mobile plate 12 all together.

The plurality of sub-plates 124 may be inserted into a plurality of installation grooves 126 formed at appropriate positions of the bottom surface of the mobile plate 12. Springs 125 are interposed between the sub-plates 124 and the installation grooves 126, thus exerting elastic force to push the sub-plates 124. Hence, each sub-plate 124 is brought into close contact with the fixed plate 14 and stable coupling is achieved between the phase shifting patterns of the sub-plates 124 and the phase shifting patterns of the fixed plate 14.

As the mobile plate 12 has the above-described configuration in which the plurality of phase shifting patterns are formed on the plurality of sub-plates 124 individually, not all together, the mobile plate 12 can slide smoothly without flexing or distorting that might be caused on the fixed plate 14.

Figure 7:
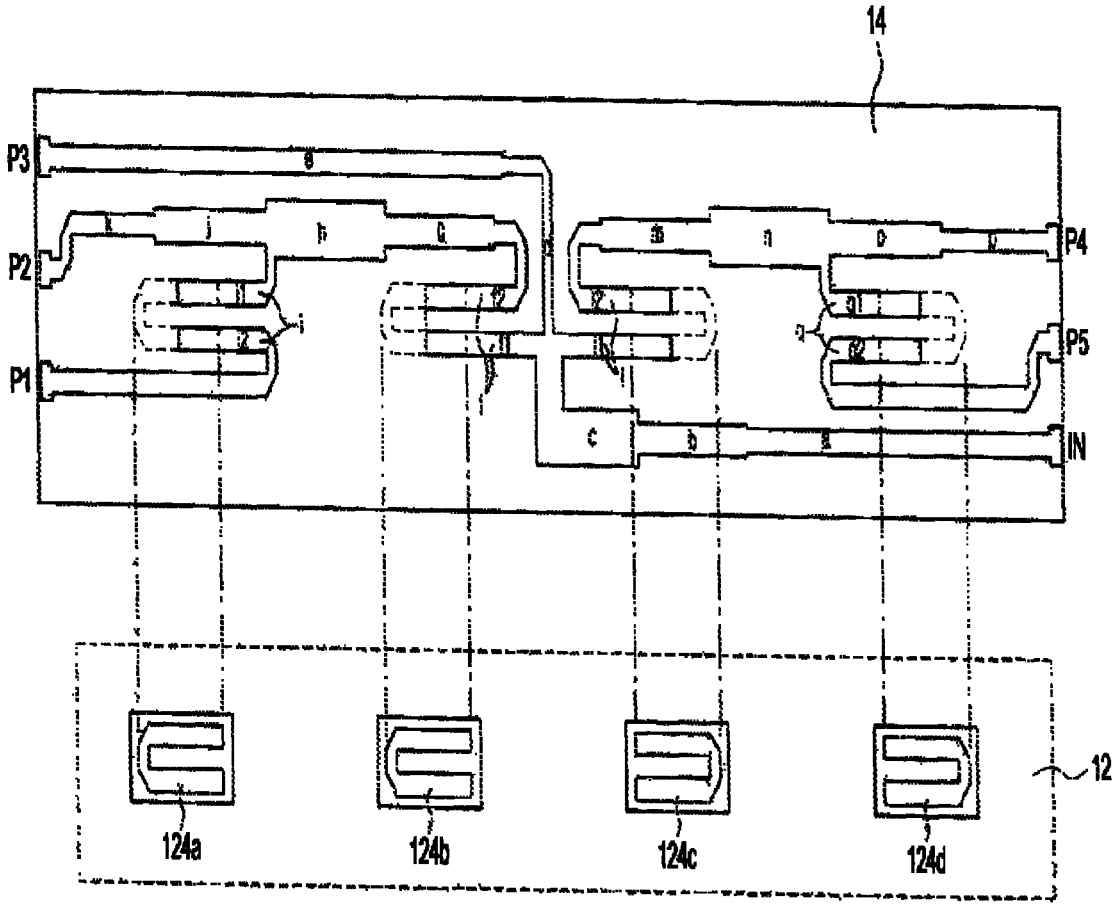
FIG. 7 is a wiring diagram of the fixed plate and the mobile plate illustrated in FIG. 1.
Figure 8:
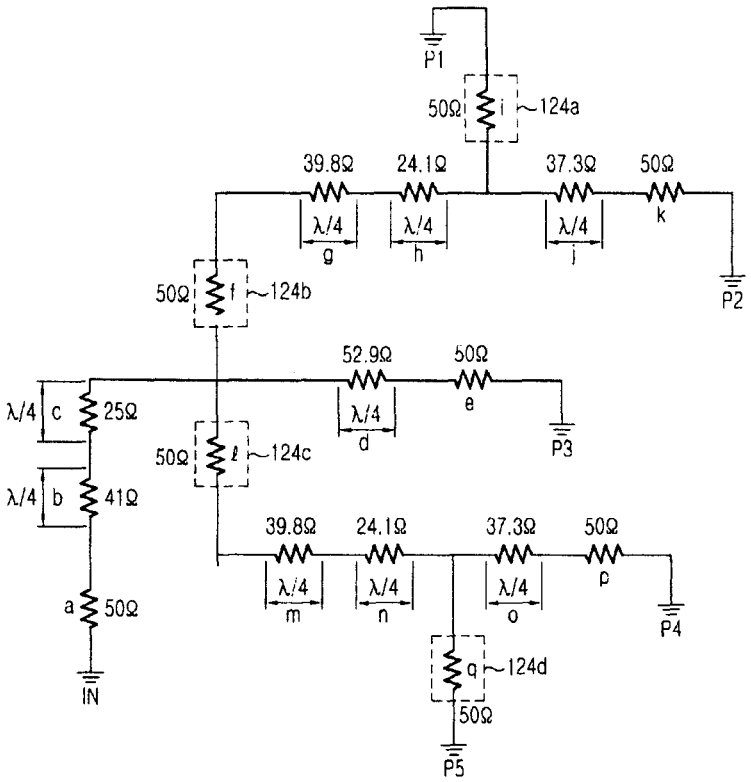
FIG. 8 is an equivalent circuit diagram of FIG. 7.

FIG. 7 is a wiring diagram of the fixed plate 14 and the mobile plate 12 illustrated in FIG. 1 and FIG. 8 is an equivalent circuit diagram of FIG. 7.

Referring to FIGS. 7 and 8, patterns IN and P1, P2, P3, P4, and P5 are formed on the fixed plate 14 in order to connect a single input port to a plurality of output ports to which signals divided from a signal input to the input port are output. The input port and the output ports are formed at upper and lower ends of the fixed plate 14 with respect to the length direction of the housing 10.

In the illustrated case of FIG. 7, a signal input to the input port is divided into five signals and the divided signals are transmitted to five output ports, by way of example. For instance, the patterns IN, P5 and P4 are formed sequentially from left to right at the lower end with respect to the length direction of the housing 10 to connect to the input port, the fifth port, and the fourth port, respectively. Also, the patterns P1, P2 and P3 are formed sequentially from left to right at the upper end with respect to the length direction of the housing 10 to connect to the first, second and third ports, respectively.

Part of the plurality of phase shifting patterns, i1-i2, f1-f2, l1-l2 and q1-q2, for dividing an input signal and shifting the phases of the divided signals, and a plurality of signal division patterns c-f1-l1-d, h-i1-j, and n-q1-o are positioned between the pattern IN for the input port and the patterns P1 to P5 for the first to fifth output ports. The connection pattern IN of the input port is extended to patterns a, b and c and then branched into patterns f, l and d at the pattern c (where general labels such as "f", etc. are used for brevity to refer collectively to all associated sub-labels such as "f1" and "f2", etc.). The pattern d is extended to a pattern e and connected to the connection pattern P3 of the third output port. The pattern f is connected to patterns g and h and then branched into patterns i and j. The pattern j is extended to a pattern k and connected to the connection pattern P2 of the second output port and the pattern i is connected to the connection pattern P1 of the first output port. The pattern l is connected to patterns m and n and then branched into patterns o and q. The pattern o is connected to the connection pattern P4 of the fourth output port through the pattern p, and the pattern q is connected to the connection pattern P5 of the fifth output port.

The patterns f, i, l and q are intended to form variable lines for phase shifting, each being designed such that it is separated into two patterns f1 and f2, i1 and i2, or q1 and q2 parallel to each other for a predetermined length. Phase shifting patterns 124*a*, 124*b*, 124*c*, and 124*d* of the mobile plate 12 are shaped into "U" at positions corresponding to the parallel portions and the end portions of the U-shaped transmission lines are positioned in correspondence with the parallel portions of the patterns f, i, l and q. Consequently, capacitance coupling occurs between the parallel portions of the patterns f, i, l and q and the U-shaped transmission lines. As the mobile plate 12 moves, the physical lengths of the transmission lines between the patterns f1 and f2, i1 and i2, l1 and l2, and q1 and q2 change due to the coupling. Thus, the resulting signals have changed phases.

In the above configuration, a signal input to the connection pattern IN of the input port is primarily divided at a pattern c-f-l-d and a divided signal at the pattern d is output to the third output port through the pattern e. A divided signal at the pattern f is primarily shifted in phase, transferred along the patterns g and h, and then secondarily divided at a pattern h-i-j. A divided signal at the pattern j is output to the second output port through the pattern k and a divided signal at the pattern i is secondarily shifted in phase and then output to the first output port.

Meanwhile, a divided signal at the pattern l, resulting from the primary signal division at the pattern c-f-l-d, is primarily shifted in phase, transferred along the patterns m and n, and secondarily divided at a pattern n-g-o. A divided signal at the pattern o is output to the fourth output port through the pattern p and a divided signal at the pattern g is secondarily shifted in phase and then output to the fifth output port.

Referring to FIG. 8 being a circuit diagram of the transmission lines, the patterns a to q are designed such that each pattern has a different resistance value for impedance matching (examples shown range from 24.1 ohms to 50 ohms) with an adjacent pattern and a division ratio for each output port is optimally set, on the whole. In addition, each pattern is designed to have a length with 214 characteristics with respect to a frequency band. For example, the resistance value of pattern a is 50 ohms, the resistance value of pattern b is 41 ohms ($\lambda/4$), the resistance value of pattern c is 25 ohms ($\lambda/4$), the resistance value of pattern d is 52.9 ohms ($\lambda/4$), the resistance value of pattern e is 50 ohms, the resistance value of pattern f is 50 ohms, the resistance value of pattern g is 39.8 ohms ($\lambda/4$), the resistance value of pattern h is 24.1 ohms ($\lambda/4$), the resistance value of pattern i is 50 ohms, the resistance value of pattern j is 37.3 ohms ($\lambda/4$), the resistance value of pattern k is 50 ohms, the resistance value of pattern l is 50 ohms, the resistance value of pattern m is 39.8 ohms ($\lambda/4$), the resistance value of pattern n is 24.1 ohms ($\lambda/4$), the resistance value of pattern o is 37.3 ohms ($\lambda/4$), the resistance value of pattern p is 50 ohms, and the resistance value of pattern q is 50 ohms.

To be more specific, the first to fifth output ports are sequentially connected to five radiation elements that are vertically arranged in an antenna. An appropriate division ratio of an input signal, not the same division ratio, is preset for each output port. That is, the division ratio of an output signal provided to each radiation element may be appropriately set to improve the sidelobe characteristics of an antenna beam pattern.

Phase variations caused by the phase shifting patterns 124*a* to 124*d* on the mobile plate 12 are set to be proportional or inversely proportional to one another. For example, the phase shifting patterns 124*a* to 124*d* are designed such that if the lengths of variable lines of the lower two phase shifting patterns 124*c* and 124*d* increase, the lengths of variable lines of the upper two phase shifting patterns 124*a* and 124*b* decrease. Therefore, the first to fifth output ports may have phase variations of 4X, 2X, 0X, −2X and −4X, respectively. X represents a phase variation. 0X indicates no phase variation and 2X/4X means that a phase variation 4X is twice larger than a phase variation 2X. In this manner, the first to fifth radiation elements connected sequentially to the first to fifth output ports have different phase variations, thereby achieving vertical beam tilting.

It is to be noted herein that the connection patterns IN, P5 and P4 of the input port, the fifth output port, and the fourth output port and the connection patterns P1, P2 and P3 of the first, second and third output ports are formed in an optimal order. That is, the phase shifting patterns are formed in a row along a reference axis according to the present invention. These patterns are designed in such a manner that, for example, a signal experiencing one phase shifting pattern is output to the second output port, while a signal experiencing two phase shifting patterns is output to the first output port, thereby achieving phase variations one of which is a double of the other.

Typically, radiation elements are arranged lengthwise in an antenna capable of vertical beam tilting, such as a phase array antenna. Thus the structure of the invention is elongated in the same direction of antenna arrangement, that is, along the length direction. In addition, the output ports are appropriately arranged, for connection to the first to fifth radiation elements, so that a power supply line required for connecting the output ports to the radiation elements is decreased in length and the resulting reduction of power loss in the phase array antenna improves gain.

Figure 9:
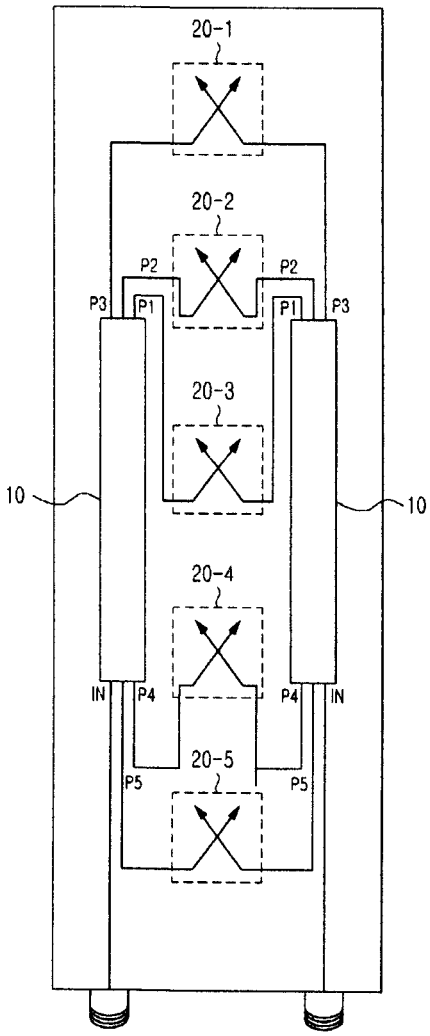
FIG. 9 is a schematic view of an antenna to which MLPSs are applied according to an exemplary embodiment of the present invention.

FIG. 9 is a schematic view of an antenna to which MLPSs are applied according to an exemplary embodiment of the present invention. Referring to FIG. 9, radiation elements each being a combination of a plurality of dipoles to generate linear orthogonal polarized waves, for example, first to fifth radiation elements 20-1, 20-2, 20-3, 20-4, and 20-5 are sequentially arranged lengthwise in an antenna. MLPSs according to the present invention may be installed at two positions, respectively in the antenna in order to generate +45 and −45-degree polarized waves. FIG. 9 shows two housings 10, where each housing 10 has a fixed plate 14 and moving plate 12 as described in connection with FIG. 7, with ports P1, P2, P3, P4, and P5 of each fixed plate 14 connected to the radiation elements 20-3, 20-2, 20-1, 20-4, and 20-5, respectively.

Connection cables are efficiently connected between the output ports of the MLPSs 10 and the radiation elements 20-1 to 20-5, without being twisted.

Figure 10:
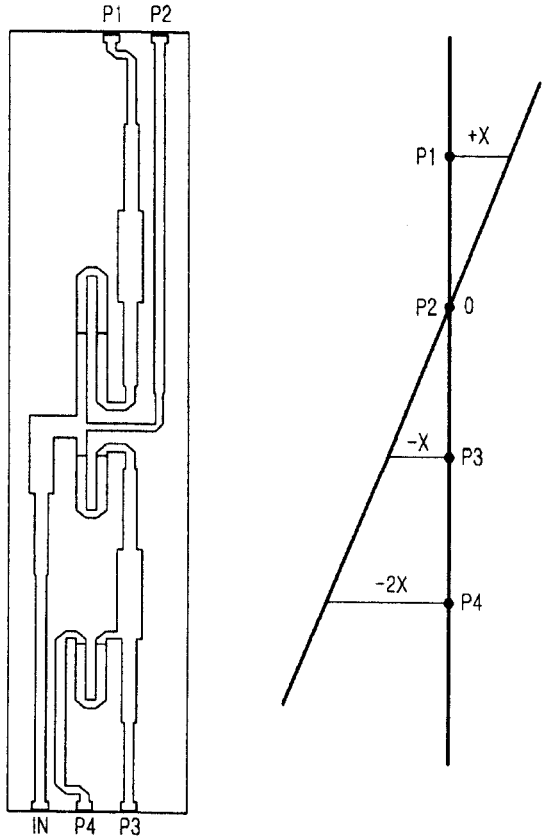
FIGS. 10A and 10B illustrate the structure of an MLPS according to another exemplary embodiment of the present invention.

FIGS. 10A and 10B illustrate the structure of an MLPS according to another exemplary embodiment of the present invention. Specifically, FIG. 10A illustrates patterns of a fixed plate and a mobile plate in an MLPS according to another exemplary embodiment of the present invention and FIG. 10B illustrates phase variations of signals output from the output ports of the MLPS.

Referring to FIGS. 10A and 10B, the MLPS according to this exemplary embodiment has one input port and four output ports. That is, the MLPS is designed to be applied to an antenna with an even number of radiation elements, that is, four radiation elements. Compared to the MLPS structure illustrated in FIGS. 1 to 9, this MLPS does not have a pattern for one output port (e. g. the connection pattern P1 of the first output port in FIGS. 1 to 9).

In the MLPS shown in FIG. 10A, patterns P1 and P2 for connecting to the first and second output ports are sequentially formed from left to right at an upper end with respect to the length direction of the housing 10, and patterns IN, P4 and P3 for connecting to the input port, the fourth port, and the third port are sequentially formed from left to right at a lower end with respect to the length direction of the housing 10. The MLPS may be designed such that phase variations for the first to fourth output patterns P1, P2, P3, and P4 are 1X, 0X, −1X and −2X, respectively, as seen in FIG. 10B.

Figure 11:
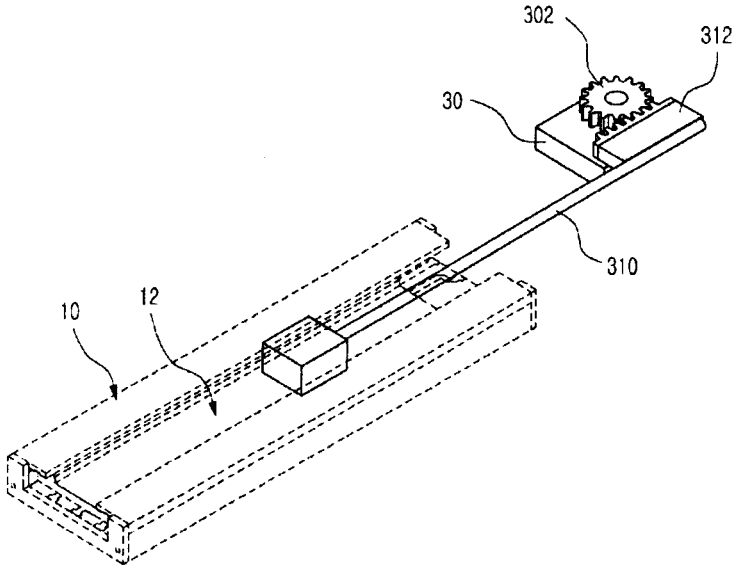
FIG. 11 illustrates a driver for an MLPS according to an exemplary embodiment of the present invention.

FIG. 11 illustrates a driver for an MLPS according to an exemplary embodiment of the present invention. Referring to FIG. 11, the MLPS has the opening on the top surface of the housing 10 to expose part of the mobile plate 12. A force-driven driver is connected to the mobile plate 12 through the opening so that the mobile plate 12 moves along the length direction of the housing 10.

More specifically, the driver may include a driving motor 30 for operating according to an external driving control signal. The driving motor 30 may be connected to a pinion gear 302. The mobile plate 12 may be connected to a side of a driving transfer shaft 310 and a rack gear 312 is formed at the other side of the driving transfer shaft 310. The rack gear 312 may be connected to the pinion gear 302 of the driving motor 30. Therefore, as the driver 30 operates, the rack gear 302 interworks with the pinion gear 312 and the driving transfer shaft 310 moves. As a result, the mobile plate 12 moves.

While the invention has been shown and described with reference to certain exemplary embodiments of the present invention thereof, it will be understood by those skilled in the art that various changes in form and details may be made therein without departing from the spirit and scope of the present invention as defined by the appended claims and their equivalents.

The invention claimed is:

1. A Multi-Line Phase Shifter (MLPS) for a vertical beam tilt-controlled antenna, comprising:

a housing shaped into an elongated rectangular box;

a fixed plate attached on an inner bottom surface of the housing and having transmission lines printed thereon, the transmission lines forming part of a plurality of phase shifting patterns and a plurality of signal division patterns, for dividing an input signal and shifting phases of divided signals; and a mobile plate installed within the housing, movably along a length direction at a position where the mobile plate contacts a surface of the fixed plate, and having transmission lines printed thereon, the transmission lines forming a remaining part of the plurality of phase shifting patterns for phase shifting by forming variable lines through coupling with the part of the plurality of phase shifting patterns;

wherein the mobile plate has an upper surface facing respective portions of an inner top surface of the housing, for slidable engagement with the inner top surface of the housing; and wherein in the fixed plate, patterns for connecting one input port to a plurality of output ports to which divided signals of a signal input to the input port are output, are printed at an upper end and a lower end with respect to a length direction of the housing, and the transmission lines are formed between the input port and the plurality of output ports.

2. The MLPS of claim 1, wherein the fixed plate is attached to the housing by soldering.

3. The MLPS of claim 1, wherein the plurality of phase shifting patterns formed on the fixed plate and the mobile plate change phases proportionally or inversely proportionally to one another and are printed in a row on a reference axis along a moving direction of the mobile plate.

4. The MLPS of claim 1, wherein the fixed plate has a structure in which one input port is connected to five output ports to which signals divided from an input signal of the input port are output, patterns for connecting to the input port, a fifth output port, and a fourth output port are formed sequentially from left to right at a lower end with respect to a length direction of the housing, patterns for connecting to first, second and third output ports are formed sequentially from left to right at an upper end with respect to the length direction of the housing, and the first to fifth output ports are sequentially mapped to five radiation elements that are vertically arranged.

5. The MLPS of claim 1, wherein the transmission lines printed on the fixed plate and the mobile plate are formed using microstrip lines, the fixed plate and the mobile plate are formed using dielectric substrates, and an insulation layer is formed on at least one of contacting surfaces of the fixed plate and the mobile plate.

6. A Multi-Line Phase Shifter (MLPS) for a vertical beam tilt-controlled antenna, comprising:

a housing shaped into an elongated rectangular box;

a fixed plate attached on an inner bottom surface of the housing and having transmission lines printed thereon, the transmission lines forming part of a plurality of phase shifting patterns and a plurality of signal division patterns, for dividing an input signal and shifting phases of divided signals; and a mobile plate installed within the housing, movably along a length direction at a position where the mobile plate contacts a surface of the fixed plate, and having transmission lines printed thereon, the transmission lines forming a remaining part of the plurality of phase shifting patterns for phase shifting by forming variable lines through coupling with the part of the plurality of phase shifting patterns;

wherein a plurality of ball plungers are installed on a surface of the mobile plate facing an inner top surface of the housing.

7. A Multi-Line Phase Shifter (MLPS) for a vertical beam tilt-controlled antenna, comprising:

a housing shaped into an elongated rectangular box;

a fixed plate attached on an inner bottom surface of the housing and having transmission lines printed thereon, the transmission lines forming part of a plurality of phase shifting patterns and a plurality of signal division patterns, for dividing an input signal and shifting phases of divided signals; and a mobile plate installed within the housing, movably along a length direction at a position where the mobile plate contacts a surface of the fixed plate, and having transmission lines printed thereon, the transmission lines forming a remaining part of the plurality of phase shifting patterns for phase shifting by forming variable lines through coupling with the part of the plurality of phase shifting patterns;

wherein the remaining part of the plurality of phase shifting patterns printed on the mobile plate are individually printed on a plurality of sub-plates that are inserted into a plurality of installation grooves formed on a bottom surface of the mobile plate, and wherein springs are interposed between the plurality of sub-plates and the plurality of installation grooves, for exerting elastic force to push the plurality of sub-plates.

8. A Multi-Line Phase Shifter (MLPS) for a vertical beam tilt-controlled antenna, comprising:

a housing shaped into an elongated rectangular box;

a fixed plate attached on an inner bottom surface of the housing and having transmission lines printed thereon, the transmission lines forming part of a plurality of phase shifting patterns and a plurality of signal division patterns, for dividing an input signal and shifting phases of divided signals; and a mobile plate installed within the housing, movably along a length direction at a position where the mobile plate contacts a surface of the fixed plate, and having transmission lines printed thereon, the transmission lines forming a remaining part of the plurality of phase shifting patterns for phase shifting by forming variable lines through coupling with the part of the plurality of phase shifting patterns;

wherein the remaining part of the plurality of phase shifting patterns printed on the mobile plate are individually printed on a plurality of sub-plates that are inserted into a plurality of installation grooves formed on a bottom surface of the mobile plate.

* * * * *